US005085409A

United States Patent [19]

Teixeira

[11] Patent Number: 5,085,409

[45] Date of Patent: Feb. 4, 1992

[54] WIRE HOLDING CAP FOR POST

[76] Inventor: Franklin W. Teixeira, 583 St. John St., Pleasanton, Calif. 94566

[21] Appl. No.: 653,774

[22] Filed: Feb. 11, 1991

[51] Int. Cl.[5] ..... B21F 27/00

[52] U.S. Cl. ..... 256/48; 256/10; 174/158 F

[58] Field of Search ..... 256/10, 48, 50, 53; 174/158 F, 163 F

[56] References Cited

U.S. PATENT DOCUMENTS 2,721,891 10/1955 Kersten ..... 174/158.2
3,267,805 8/1966 Ackerman ..... 174/158 F
4,623,756 11/1986 Wilson, Jr. ..... 174/158 F

FOREIGN PATENT DOCUMENTS 2457950 1/1981 France ..... 256/48

*Primary Examiner*—Andrew V. Kundrat

*Attorney, Agent, or Firm*—Thomas E. Schatzel

[57] ABSTRACT

A cap mountable on top of a post connects to, holds and supports, a pair of wires. The cap guards sharp edges at the post top to prevent accidental contact with people or livestock. The cap is readily visible as a marker, a reflector or a color coded sign. A portion of the cap fits closely to the upper post while a crown portion projects thereabove and a bill portion projects outwardly therefrom. The crown and bill portions each define a cavity longitudinally aligned for holding a wire adjacent the post. A narrow throat having a least dimension slightly larger than the diameter of the wire to be held extends laterally from the cavity to a flared mouth that further extends and opens in an upwardly direction. A wire can be moved laterally from a position adjacent the flared mouth, through the narrow throat, to a position within the cavity and can be removed therefrom in a reverse manner.

15 Claims, 1 Drawing Sheet

WIRE HOLDING CAP FOR POST

BACKGROUND OF THE INVENTION

1. Field of the Invention

This invention relates to a post cap that serves as a holder and support for fence, tension or trellis wire, an insulator, a safety guard to prevent persons or livestock from contacting sharp edges at the top of a post, a marker, a reflector, or a color coded sign. More specifically, it concerns a connection for attaching fence or trellis wire to a supporting post by lateral movement of a tensioned wire from a position adjacent the connection to a supportive position within the connection.

2. Description of the Prior Art

It is desirable for one man to be able to build a fence or a trellis and tighten wire used therein. Sometimes wire can be tied to the side of a post, but there are situations that require different connections. When a wire supports a heavy load, such as a trellis wire supporting grape vines, it is desirable that the wire pass vertically above the post that acts as a support column. In the case of an electrified fence, the live wire must be insulated and it is desirable that the wire be medially located so that animals on either side of the post have an equal chance of contacting the live wire. Support rings and annular insulators have been used for holding wire at posts, but the wire must be inserted axially through the ring openings. When the wire is tightened between three or more posts with an intermediate post ring opening being out of either vertical or horizontal alignment, the tensioned wire tends to straighten out, placing stress on the intermediate post ring and perhaps causing movement. Thus, alignment of intermediate post ring openings is important, but a difficult task for one man working alone.

When fencing wire is attached to the side of a post, it is customary to allow spacing between the top fencing wire and the top of the post. Thus, the full post height is not utilized. By supporting the top fencing wire at the top of the post, either a shorter post could be used for the same height of fence or the same length post could be driven further into the ground for more support.

Steel fence posts of the studded T-type are cut to length when hot in a gullotine shear. They are driven into the ground either with a sledge hammer or a fence post drive and this can results in deformation of the post top. Thus, edges at the top of a post are sharp and can cause serious injury to people and animals that contact them.

It is desirable to make a fence readily visible so that animals and people will not run into it. The upper ends of fence posts are dipped in paint of a color contrasting with the remainder of the posts and the intended vicinity thereof so as to serve as a marker of fence location. U.S. Pat. No. 3,267,805, issued Aug. 23, 1966 to Ackerman, discloses plastic caps with light reflectors for use on fence posts adjacent rural roads to delineate the marginal lines of the roadway at night by reflecting light from the headlights of passing vehicles. This patent also discloses that plastic caps can be fabricated from synthetic resin pigmented in various colors.

U.S. Pat. No. 1,444,834, issued Feb. 13, 1923 to Hindmarsh, discloses a cap used for driving fence posts. U.S. Pat. No. 1,021,408, issued Mar. 26, 1912, to Huber, shows a metallic fence post having wire receiving recesses for holding line wires.

SUMMARY OF THE PRESENT INVENTION

An object of the present invention is to provide a connection for attaching fence, tension or trellis wire to a supporting post by lateral movement of a tensioned wire from a position adjacent the connection to a supportive position therein.

Another object of the present invention is to provide electrical insulation between supported wires and a supporting post.

Another object of the invention is to provide a safety guard to prevent persons or livestock from contacting sharp edges at the top of a post.

A further object of the invention is to provide a post cap that is readily visible for a marker, a reflector, or a color coded sign.

A cap has a portion fitting closely to the upper portion of a post and has a lower margin. A portion projects from the closely fitting portion to a location spaced from the post. The projecting portion defines a cavity longitudinally aligned for holding a wire of predetermined diameter adjacent the post. A narrow throat extends laterally from the cavity and has a least dimension slightly larger than the cavity of the wire to be held. A flared mouth extends from the throat and opens in an upwardly direction. The wire can be moved laterally from a position adjacent the flared mouth, through the narrow throat, to a position within the cavity and removed therefrom in a reverse manner.

Advantages of the present invention include the ability to connect and disconnect a tensioned wire by lateral movement between adjacent and supportive positions, electrical insulation between supported wires and a supporting post, protection of persons or livestock from contacting sharp edges at the top of a post, and visibilit as a marker, a reflector or a color coded sign.

These and other objects and advantages of the present invention will no doubt become obvious to those or ordinary skill in the art after having read the following detailed description of the preferred embodiment which is illustrated in the drawings.

IN THE DRAWINGS

DESCRIPTION OF THE PREFERRED EMBODIMENT

Figure 1:
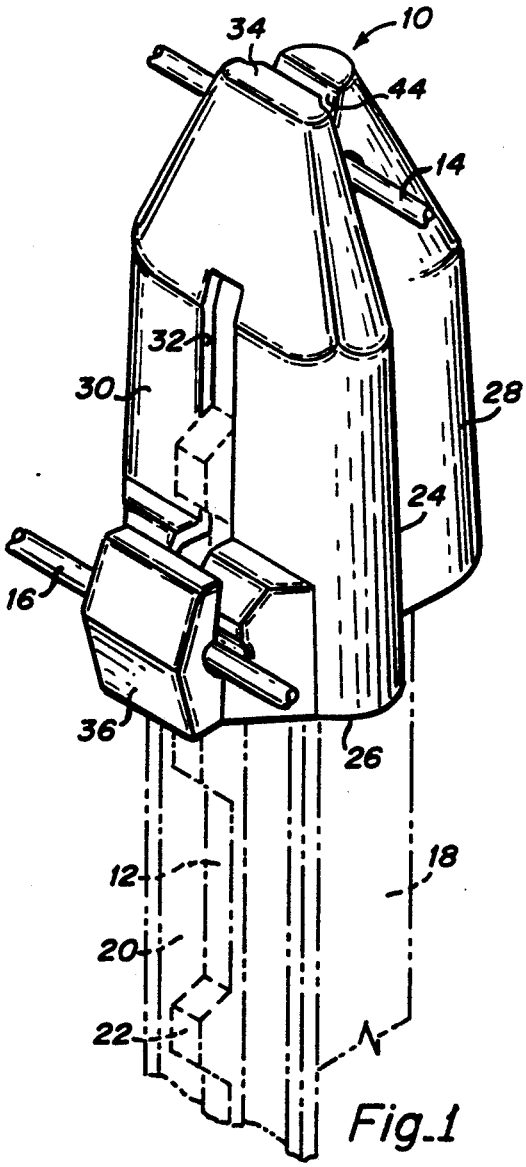
FIG. 1 is a perspective view of a post cap embodying the present invention located at the upper end of a studded T-type fence post indicated in phantom line.
Figure 2:
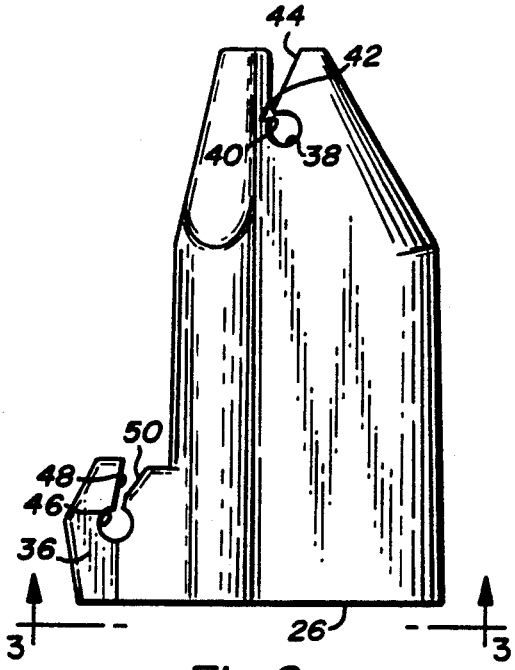
FIG. 2 is a side elevational view of the post cap shown in FIG. 1.

With reference to FIG. 1, a cap, indicated by the general reference numeral 10, is shown mounted at the upper end of a studded T-type fence post 12 for supporting fence or trellis wires 14 and 16. The wire 14 is positioned verticall above the post, while the wire 16 is positioned adjacent one side of the post. A web 18 is crossed by a flange 20 in a T-like fashion and studs 22 project at regular intervals from the side of the flange opposite the web to form an integral structure for the post. The studs provide vertical support for attaching additional fencing wires to the post.

The cap 10 has a portion 24 fitting closely to the upper post and having a lower margin 26. The portion 24 includes a web encasement 28 and a flange encasement 30. A slot 32 is provided in the flange encasement so that studs 22 can project therethrought as the cap is fitted on or removed from the post. Since the studs can be located at the top of the post or any distance spaced therefrom, the slot extends the full height of the portion 24. A crown portion 34 projects from the closely fitting portion to a location spaced above the post and a bill portion 36 projects outwardly from the flange encasement near the lower margin of the closely fitting portion.

The crown portion 34 defines a cavity 38 longitudinally aligned for holding a wire above the post. A narrow throat 40 extends laterally from the cavity and has a least dimension slightly larger than the diameter of the wire to be held. A turn 42 is provided in the narrow throat changing direction of its lateral extension so that it is more difficult for a wire to be accidentally removed through the throat. A flared mouth 44 extends from the narrow throat and opens in an upwardly direction. The bill portion defines a cavity 46 longitudinally aligned for holding a wire adjacent the flange side of the post. A narrow throat 48 extends laterally from the cavity and has a least dimension slightly larger than the diameter of the wire to be held in the bill portion cavity. A flared mouth 50 extends from the throat and opens in an upwardly direction.

Figure 3:
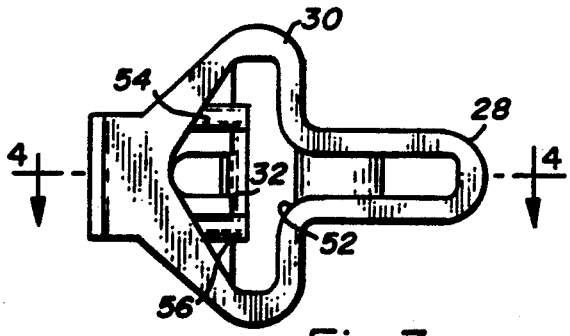
FIG. 3 is a bottom view taken along line 3—3 of FIG. 2.
Figure 4:
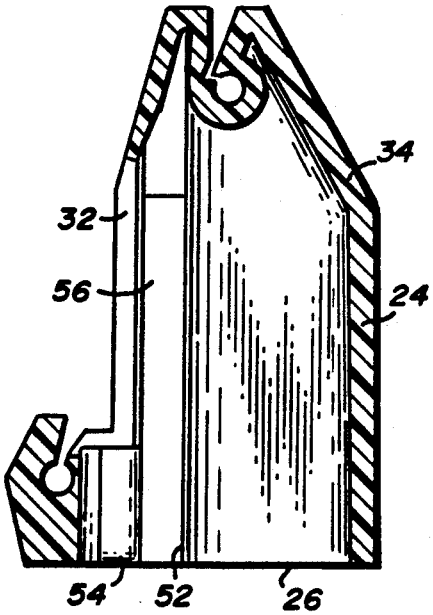
FIG. 4 is a transverse section taken along line 4—4 of FIG. 3.

Looking now at FIG. 3, a web encasement 28 and the flange encasement 30 define a T-shaped space 52 for receiving the upper portion of the post 12. A pair of stiffeners 54 and 56 are provided on opposite sides of the slot 32 for strengthening the flange encasement. As shown in FIG. 4, the closely fitting portion 24 is tapered from the lower margin 26 to the crown portion 34 for wedging in place upon the upper post.

A fence or trellis can be built by one man driving posts at intervals spaced at whatever distance the wire is to be stretched between. The wire can be tightened between the posts. Then the intermediate posts can be driven using the tightened wire for both horizontal and vertical alignment. A cap 10 is slipped over the top of each intermediate post 12 and the tightened wire should be located adjacent either a flared mouth 44 or 50 at each post. Then the wire can be moved laterally through the narrow throat 42 or 48 to a postion within the cavity 38 or 46. The wire can be removed from the cavity in a reverse manner. Cavity 46 can support a wire from which fencing wire is suspended or it can support the top of a fencing mesh. The cap can support various types of fencing such as chain link, no climb, V-mesh, two-by-four, hog wire, tension wire, barb wire, plastic fence, snow fence, wind brake, rodent control, ranch stock and construction.

Cap 10 is made of molded plastic such as vinyl. The plastic can be pigmented in various colors for color coding purposes. In vineyards, a different color cap can be used for each kind of grape vine supported by the trellis wires. Workmen not familiar with the various kinds of grape vines can be told to prune or pick the grape vines supported by caps having a specific color. Similarly, caps can be used to color code paddocks, pastures and roadways. The caps can be made to reflect light by using a light reflective pigment or dye. Minute light reflective elements could be embedded in the outer surface of the plastic.

From the foregoing description, it will be seen that a cap 10 has a portion 24 fitting closely to the upper portion of a post 12 and has a lower margin 26. A crown portion 34 projects from the closely fitting portion to a location spaced above the post top. The crown portion defines a cavity 38 longitudinally aligned for holding a wire 14 above the post. A narrow throat 40 extends laterally from the cavity and has a least dimension slightly larger than the diameter of the wire. A turn 42 is provided in the narrow throat changing direction of its lateral extension. A flared mouth 44 extends from the throat and opens in an upwardly direction. A bill portion 36 projects outwardly from the closely fitting portion near the lower margin 26 thereof. The bill portion defines a cavity 46 longitudinally aligned for holding a wire 16 adjacent one side of the post. A narrow throat 48 extends laterally from the cavity 46 and has a least dimension slightly larger than the diameter of wire 16. A flared mouth 50 extends from the throat 48 and opens in an upwardly direction. While the disclosed cap 10 is adapted for mounting on a studded T-type steel fence post, the invention can be adapted to a cap for mounting on a round pipe post or a wooden post.

Although the present invention has been described in terms of the presently preferred embodiment, it is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A cap mountable on top of a support post for connecting at least one wire of predetermined diameter thereto, said cap comprising:

a portion for fitting closely to an upper portion of said post and having a lower margin, a crown portion projecting from the closely fitting portion for projecting to a location spaced above the top of the post, said projecting portion defining a cavity for longitudinal alignment with said wire for holding said wire adjacent the post, a narrow throat extending laterally from the cavity and having a least dimension slightly larger than the diameter of the wire to be held, and a flared mouth extending from the throat and opening in an upwardly direction, whereby the wire can be moved laterally from a position adjacent the flared mouth, through the narrow throat, to a position within the cavity and can be removed therefrom in a reverse manner.

2. The post cap of claim 1 wherein, said narrow throat is in a section transversely of the cavity and extends obliquely to the vertical direction.

3. The post cap of claim 2 wherein, said narrow throat includes a turn reversing direction of the lateral extension.

4. A cap mountable on top of a support post for connecting a plurality of wires of predetermined diameters thereto, said cap comprising:

a portion for fitting closely to an upper portion of said post and having a lower margin, a crown portion projecting from the closely fitting portion to a location spaced above the post top, said crown portion defining a cavity for longitudinal alignment with said wire for holding one of the wires above the post, a narrow throat extending laterally from the cavity and having a least dimension slightly larger than the diameter of one wire, and a flared mouth extending from the throat and opening in an upwardly direction, and a bill portion projecting outwardly from one side of the closely fitting portion near the lower margin thereof, said bill portion defining a cavity longitudinally aligned for holding another wire adjacent one side of the post, a narrow throat extending laterally from the cavity and having a least dimension slightly larger than the diameter of the wire to be held in the bill portion cavity, and a flared mouth extending rom the throat and opening in an upwardly direction, whereby the wires can be moved laterally from positions adjacent the respective flared mouths through the narrow throats to positions within the cavities and removed therefrom in a reverse manner.

5. The post cap of claim 4 wherein, the cap is made of molded plastic vinyl and the post is made of steel, said portion fitting closely to the top of the post serving as a safety guard to prevent persons or livestock from contacting sharp edges at the top of the post.

6. The post cap of claim 5 wherein, the cap provides electrical insulation between the wires and the post.

7. The post cap of claim 4 wherein, the cap is made of plastic vinyl having a readily visible color to serve as a marker at the top of the post.

8. The post cap of claim 7 wherein, the cap color is a color coded sign.

9. The post cap of claim 4 wherein, the cap is made of molded plastic vinyl that has been pigmented to be light reflective.

10. The post cap of claim 4 wherein, said closely fitting portion has a slot therein for receiving studs on the post.

11. The post cap of claim 10 wherein, a pair of stiffeners are provided near opposite sides of the slot.

12. A cap mountable on top of a support post for connecting at least one wire of predetermined diameter thereto, said cap comprising:

a portion for fitting closely to an upper portion of said post and having a lower margin, a portion projecting laterally from the closely fitting portion to a location spaced laterally from the post, said projecting portion defining a cavity for longitudinal alignment with said wire for holding the wire adjacent the post, a narrow throat extending laterally from the cavity and having a least dimension slightly larger than the diameter of the wire to be held, and a flared mouth extending from the throat and opening in an upwardly direction, the throat further including a turn reversing direction of the lateral dimension;

whereby the wire can be moved laterally from a position adjacent the flared mouth, through the narrow throat, to a position within the cavity and can be removed therefrom in a reverse manner.

13. The post cap of claim 12 wherein, said projecting portion is a bill that protrudes outwardly from the side of the closely fitting portion near the lower margin thereof.

14. The post cap of claim 12 wherein, said narrow throat is in a section transversely of the cavity and extends obliquely to the vertical direction.

15. The cap post of claim 12 wherein, said projecting portion is a bill that protrudes outwardly from the side of the closely fitting potion near the lower margin thereof.

* * * * *